US008714808B2

(12) United States Patent
Yamanaka

(10) Patent No.: US 8,714,808 B2
(45) Date of Patent: May 6, 2014

(54) CONTAINER FOR MIXING TWO FLUIDS

(75) Inventor: Nobuo Yamanaka, Ichikawa (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 374 days.

(21) Appl. No.: 11/661,601

(22) PCT Filed: Aug. 22, 2005

(86) PCT No.: PCT/JP2005/015211

§ 371 (c)(1),
(2), (4) Date: Mar. 1, 2007

(87) PCT Pub. No.: WO2006/035558

PCT Pub. Date: Apr. 6, 2006

(65) Prior Publication Data

US 2007/0280042 A1 Dec. 6, 2007

(30) Foreign Application Priority Data

Sep. 29, 2004 (JP) ..... 2004-285530
Jan. 31, 2005 (JP) ..... 2005-056579

(51) Int. Cl.
*B65D 25/08* (2006.01)

(52) U.S. Cl.
USPC ..... 366/130; 206/222

(58) Field of Classification Search
USPC ..... 206/222, 219–221; 222/145.5; 604/87, 604/88; 366/130; 220/568; 215/DIG. 8
See application file for complete search history.

(56) References Cited

U.S. PATENT DOCUMENTS 2,343,067 A * 2/1944 Luce ..... 123/90.45
2,653,609 A * 9/1953 Smith ..... 604/416

(Continued)

FOREIGN PATENT DOCUMENTS

DE 2432290 A * 1/1976
FR 2569666 A1 3/1986

(Continued)

OTHER PUBLICATIONS

Dec. 8, 2009 European Search Report issued in PCT/JP2005015211.

(Continued)

*Primary Examiner* — Charles E Cooley
(74) *Attorney, Agent, or Firm* — Oliff PLC

(57) ABSTRACT

A container for mixing two liquids and the like includes: a container; a pouring cylinder that is provided extending upwards on a top portion of the container; an upward facing step portion that is formed on the container so as to be positioned below the pouring cylinder; a cap whose inner circumferential surface is screwed onto an outer circumferential surface of the pouring cylinder; a small container that is placed on an inner side of the cap; a cuttable first sheet that forms a bottom surface of the small container; a removable cylinder that is provided at a bottom end of the cap and is interposed between the cap and the upward facing step portion, and that is removed from the cap prior to the cap being screwed down onto the pouring cylinder; and a first cutter that is provided on the container so as to face a bottom surface of the small container that is placed on the inner side of the cap, wherein the small container is made to approach the first container as a result of the cap being screwed down onto the pouring cylinder, and the first sheet is then cut by the first cutter.

15 Claims, 11 Drawing Sheets

(56) References Cited

U.S. PATENT DOCUMENTS

| | | | | | |
|---|---|---|---|---|---|
| 2,653,610 | A * | 9/1953 | Smith | 206/222 |
| 2,653,611 | A * | 9/1953 | Smith | 206/222 |
| 2,721,552 | A * | 10/1955 | Nosik | 206/222 |
| 2,748,590 | A * | 6/1956 | Kubik et al. | 70/367 |
| 2,992,685 | A * | 7/1961 | Madsen | 416/245 R |
| 3,220,588 | A * | 11/1965 | Lipari | 206/222 |
| 3,425,598 | A * | 2/1969 | Kobernick | 222/83 |
| 3,443,726 | A * | 5/1969 | Godsted et al. | 222/80 |
| 3,715,189 | A * | 2/1973 | Nighohossian et al. | 422/61 |
| 3,720,523 | A * | 3/1973 | Nakagami | 26/115 |
| 3,720,524 | A * | 3/1973 | Nakagami | 426/115 |
| 4,159,570 | A * | 7/1979 | Baskas et al. | 433/90 |
| 4,195,731 | A * | 4/1980 | Cavazza | 206/222 |
| 4,247,001 | A * | 1/1981 | Wiegner | 206/222 |
| 4,408,690 | A * | 10/1983 | Ferrero | 206/222 |
| 4,465,183 | A | 8/1984 | Saito et al. | |
| 4,614,437 | A * | 9/1986 | Buehler | 366/130 |
| 4,705,191 | A * | 11/1987 | Itzel et al. | 222/80 |
| 4,757,916 | A * | 7/1988 | Goncalves | 222/83 |
| 4,847,528 | A * | 7/1989 | Eguchi et al. | 310/239 |
| 5,038,951 | A * | 8/1991 | Rizzardi | 215/256 |
| 5,048,872 | A * | 9/1991 | Gehring | 285/92 |
| 5,186,347 | A * | 2/1993 | Freeman et al. | 220/254.1 |
| 5,362,110 | A * | 11/1994 | Bynum | 285/87 |
| 5,379,920 | A * | 1/1995 | Lisak | 222/129 |
| 5,465,835 | A * | 11/1995 | Schumacher et al. | 206/221 |
| 5,782,345 | A * | 7/1998 | Guasch et al. | 206/222 |
| 5,836,479 | A * | 11/1998 | Klima et al. | 222/83.5 |
| 6,041,671 | A * | 3/2000 | Erikson et al. | 74/441 |
| 6,148,996 | A * | 11/2000 | Morini | 206/222 |
| 6,164,495 | A * | 12/2000 | Manesis | 222/129 |
| 6,274,267 | B1 * | 8/2001 | Pate | 429/185 |
| 6,375,041 | B1 * | 4/2002 | Klima et al. | 222/129 |
| 6,454,088 | B2 * | 9/2002 | Mollstam et al. | 206/222 |
| 6,959,839 | B2 * | 11/2005 | Roth et al. | 222/83 |
| 7,018,089 | B2 * | 3/2006 | Wenz et al. | 366/130 |
| 7,306,117 | B2 * | 12/2007 | Roth et al. | 222/83 |
| 7,347,322 | B2 * | 3/2008 | Cho | 206/222 |
| 7,475,774 | B2 * | 1/2009 | Clarkson | 206/222 |
| 7,506,782 | B2 * | 3/2009 | Walters et al. | 222/83 |
| 7,506,784 | B2 * | 3/2009 | Lee | 222/525 |
| 7,546,919 | B2 * | 6/2009 | Lee | 206/221 |
| 7,562,782 | B2 * | 7/2009 | Yorita | 215/228 |
| 7,584,842 | B2 * | 9/2009 | Neumeyer et al. | 206/222 |
| 8,276,748 | B2 * | 10/2012 | Nyambi et al. | 206/222 |
| 8,479,943 | B2 * | 7/2013 | Wilhelm | 206/219 |
| 2002/0096440 | A1 * | 7/2002 | Kasuya | 206/222 |
| 2003/0089627 | A1 | 5/2003 | Chelles et al. | |
| 2003/0132244 | A1 * | 7/2003 | Birkmayer et al. | 222/83 |
| 2003/0213709 | A1 * | 11/2003 | Gibler et al. | 206/219 |
| 2005/0279653 | A1 * | 12/2005 | Williams-Lucas et al. | 206/219 |
| 2006/0289316 | A1 * | 12/2006 | Henry | 206/219 |
| 2007/0045134 | A1 * | 3/2007 | Dvorak et al. | 206/222 |
| 2007/0280042 | A1 * | 12/2007 | Yamanaka | 366/185 |
| 2008/0093326 | A1 * | 4/2008 | Cho | 215/228 |
| 2008/0116221 | A1 * | 5/2008 | Roth et al. | 222/129 |
| 2008/0124432 | A1 * | 5/2008 | Ma | 426/115 |
| 2008/0142032 | A1 * | 6/2008 | Liberty et al. | 132/200 |
| 2008/0286438 | A1 * | 11/2008 | Newell | 426/665 |
| 2008/0289976 | A1 * | 11/2008 | Henry | 206/222 |
| 2009/0236244 | A1 * | 9/2009 | Frutin | 206/219 |
| 2013/0292275 | A1 * | 11/2013 | Smart | 206/222 |

FOREIGN PATENT DOCUMENTS

| | | | | |
|---|---|---|---|---|
| JP | Y1 42-1276 | | 1/1967 | |
| JP | U 58-76532 | | 5/1983 | |
| JP | 59-168340 | U | 11/1984 | |
| JP | Y2 1-26592 | | 8/1989 | |
| JP | 06080166 | A * | 3/1994 | B65D 81/32 |
| JP | U-6-78282 | | 11/1994 | |
| JP | U-7-11540 | | 2/1995 | |
| JP | Y2 7-6140 | | 2/1995 | |
| JP | A 9-255047 | | 9/1997 | |
| JP | Y2 2591274 | | 12/1998 | |
| JP | Y2 2598170 | | 5/1999 | |
| JP | Y2 2599763 | | 7/1999 | |
| JP | 11227774 | A * | 8/1999 | |
| JP | A-2001-261053 | | 9/2001 | |
| JP | A-2003-292013 | | 10/2003 | |
| JP | A 2004-299760 | | 10/2004 | |
| WO | WO 98/03265 | | 1/1998 | |
| WO | WO 01/30665 | A1 | 5/2001 | |
| WO | WO 2004/000667 | A1 | 12/2003 | |

OTHER PUBLICATIONS

Feb. 22, 2011 Notice of Reasons for Rejection in Japanese Appln. No. 2006-537649, w/English language translation.

European Search Report for EP Application No. 10 01 4589.5, Feb. 2, 2011.

Jan. 4, 2012 Office Action issued in Japanese Patent Application No. 2006-537649 (with translation).

* cited by examiner

CONTAINER FOR MIXING TWO FLUIDS

TECHNICAL FIELD

The present invention relates to a container for mixing two liquids and the like that mixes a plurality of types of contents such as mixing two liquids or mixing a different type of powder or the like in one liquid.

Priority is claimed on Japanese Patent Application Nos. 2004-285530, filed Sep. 29, 2004, and 2005-56579, filed Jan. 31, 2005, the contents of which are incorporated herein by reference.

BACKGROUND ART OF THE INVENTION

A container for mixing two liquids and the like is known (see, for example, Patent document 1 below) in which a small container that contains a second liquid and the like is fitted inside a top portion of a container body, or alternatively in which an intermediate cylinder component bottom portion whose circumferential wall top portion forms a removable cylinder is screwed into an aperture neck portion of a suitable container body, and a bottom portion of a component that is equipped with a nozzle is screwed into this intermediate cylinder component. By removing the removable cylinder and pressing down the nozzle-equipped component, a sheet that blocks both top and bottom surfaces of the small container is broken by a cutter suspended from a bottom end of the nozzle-equipped component, and the second liquid and the like inside the small container drops inside the container body and mixes with a first liquid contained inside the container body.

PATENT DOCUMENT 1: Japanese Registered Utility Model No. 2598170

DETAILED DESCRIPTION OF THE INVENTION

Problems to be Solved by the Invention

In a conventional container for mixing two liquids and the like, because it is necessary to cut a top surface and a bottom surface of a small container using a cutter, it is necessary to secure a distance for the cutter to move that is longer than the distance from the top surface to the bottom surface of the small container. As a result, relative to the overall size of the container, the proportion that is occupied by the top portion of the container body which houses the cutter is large.

The present invention was conceived in order to solve the above described problem and it is an object thereof to provide a container for mixing two liquids and the like in which the proportion that is occupied by the top portion of the container body which houses the cutter relative to the overall size of the container is small, and that has a small size while providing the same volume, and that has a small number of component elements, and that is easy to use.

Means for Solving the Problem

A container for mixing two liquids and the like having the structure described below is used in order to solve the above described problem. Namely, the container for mixing two liquids and the like of the present invention includes: a container; a pouring cylinder that is provided extending upwards on a top portion of the container; an upward facing step portion that is formed on the container body so as to be positioned below the pouring cylinder; a cap whose inner circumferential surface is screwed onto an outer circumferential surface of the pouring cylinder; a small container that is placed on an inner side of the cap; a cuttable first sheet that forms a bottom surface of the small container; a removable cylinder that is provided at a bottom end of the cap and is interposed between the cap and the upward facing step portion, and that is removed from the cap prior to the cap being screwed down onto the pouring cylinder; and a first cutter that is provided on the container so as to face a bottom surface of the small container that is placed on the inner side of the cap, wherein the small container is made to approach the first cutter as a result of the cap being screwed down onto the pouring cylinder, and the first sheet is then cut by the first cutter.

According to the container for mixing two liquids or the like of the present invention, a first sheet that forms the bottom surface of a small container that is placed inside a cap is located so as to face a first cutter that is placed on a pouring cylinder. When the cap is screwed down onto the pouring cylinder, the bottom surface of the small cylinder approaches the first cutter and the first sheet is cut by the first cutter. When the first sheet is cut, a fluid such as a liquid and the like that is contained in the small container flows into the small container through the pouring cylinder and mixes with another fluid contained in the small container.

Namely, because two fluids can be mixed together simply by cutting the first sheet, it is not necessary to secure a movement distance for the first cutter that is as long as in a conventional structure. Accordingly, because the proportion that is occupied by the top portion of the container which houses a first cutter relative to the overall size of the container is smaller than in a conventional structure, it is possible to achieve a reduction in the size of the container. Moreover, it is possible to reduce the number of components compared with a conventional structure.

In the container for mixing two liquids and the like of the present invention, it is preferable for the container to be provided with a container body, an aperture portion that is provided extending upright from a top portion of the container body, and a pouring component that has the pouring cylinder and is fitted onto the aperture portion such that it is unable to pivot, and for the pouring cylinder to be made to extend upright from the top portion of the container as a result of the pouring component being fitted to the aperture portion, and for the first cutter to be provided on the pouring component so as to protrude upwards.

According to the above described container for mixing two liquids and the like, by combining the container body that is provided with an aperture portion with the pouring component having a pouring cylinder, it is possible to easily form a container having a pouring cylinder.

In the container for mixing two liquids and the like of the present invention, it is preferable for the pouring component to be provided with: a flange-shaped apex plate that is provided at a bottom end of the pouring cylinder; an outer cylinder that hangs vertically down from the apex plate; an inner cylinder that is placed on an inner side of the outer cylinder and hangs vertically downwards from the apex plate, and an inward facing flange that is provided so as to protrude from the apex plate onto an inner side of the pouring cylinder, and for the first cutter to be provided on the inward facing flange so as to protrude upwards, and for the pouring component to be fitted to the aperture portion such that the aperture portion becomes inserted between the outer cylinder and the inner cylinder.

According to the above described container for mixing two liquids and the like, because the first cutter is provided on an inward facing flange of the pouring component, it is possible to easily form the first cutter on the container.

In the container for mixing two liquids and the like of the present invention, it is preferable for the cap to be provided with an apex wall, an outer circumferential wall that hangs vertically downwards from the apex wall, and an inner circumferential wall that is placed on an inner side of the outer circumferential wall and hangs vertically downwards from the apex wall, and for the small container to engage with an inner side of the inner circumferential wall of the cap, and for the cap to be screwed onto the pouring cylinder so that the inner circumferential wall is inserted on an inner side of the pouring cylinder.

According to the above described container for mixing two liquids and the like, by fitting the small container on the inner side of the inner circumferential wall of the cap, the small container can be easily fixed to the cap.

In the container for mixing two liquids and the like of the present invention, it is preferable for the small container to be provided with an apex wall, a circumferential wall that hangs vertically downwards from the apex wall, and an outward facing flange that is provided so as to protrude outwards from the bottom end of the circumferential wall, and for a top surface of the outward facing flange to be adhered to a bottom end surface of the inner circumferential wall of the cap, and for an interior of the inner circumferential wall to be tightly sealed by the small container.

According to the above described container for mixing two liquids and the like, when a fluid is being loaded into the small container and the like, no cleaning liquid or the like enters between the cap and the small container so that an excellent level of hygiene is maintained.

In the container for mixing two liquids and the like of the present invention, it is preferable for the container to be provided with a cuttable second sheet that closes off the pouring cylinder, and for the cap to be provided with a second cutter that is positioned facing the second sheet, and for the second cutter to be made to approach the second sheet as a result of the cap being screwed down onto the pouring cylinder and for the second cutter to then cut the second sheet.

According to the above described container for mixing two liquids and the like, because the pouring cylinder of the container is closed off by the second sheet, when the container for mixing two liquids and the like is being transported, the fluid contained in the container does not enter into the interior of the cap. Accordingly, when removing the cap, it is possible to prevent any unintentional fluid spillage.

In the container for mixing two liquids and the like of the present invention, it is preferable for the second sheet to be joined to a bottom end surface of the pouring cylinder by insert molding, or for the second sheet to be adhered to the bottom end surface of the pouring cylinder. Alternatively, it is preferable for the second sheet to be formed integrally with the bottom end surface of the pouring cylinder when the pouring component is molded.

According to the above described container for mixing two liquids and the like, the second sheet can be joined easily to the pouring component.

In the container for mixing two liquids and the like of the present invention, it is preferable for an end surface of the second sheet to be covered by the bottom end portion of the pouring cylinder by insert molding.

According to the above described container for mixing two liquids and the like, because the end surface of the second sheet is covered by the bottom end portion of the pouring cylinder, the end surface of the second sheet does not come into contact with the fluid that is contained in the container, and the material of the second sheet that is exposed to the end surface does not become eroded by the fluid. Accordingly, it is possible to improve the durability of the second sheet.

In the container for mixing two liquids and the like of the present invention, it is preferable for the second sheet to be inclined relative to a vertical direction of the container.

According to the above described container for mixing two liquids and the like, by inclining the second sheet, the second sheet can be reliably cut by the second cutter even if the gap between the second cutter and the second sheet is not precisely controlled.

In the container for mixing two liquids and the like of the present invention, it is preferable for the small container to be provided with an apex wall and a circumferential wall that hangs vertically downwards from the apex wall, and for the apex wall and the circumferential wall of the small container to be formed by thickly stacking a plurality of membranes having barrier properties, and for the first sheet that forms the bottom surface of the small container to be formed by stacking a plurality of membranes having barrier properties.

According to the above described container for mixing two liquids and the like, by forming the first sheet that has excellent corrosion resistance by stacking a plurality of membranes, it is possible to prevent the first sheet being degraded over time by the fluid contained in the small container. Moreover, by improving the gas barrier properties thereof, the preservability of the fluid is improved.

In the container for mixing two liquids and the like of the present invention, it is preferable for the second sheet to be formed by stacking a plurality of membranes having barrier properties.

According to the above described container for mixing two liquids and the like, by forming the second sheet that has excellent corrosion resistance by stacking a plurality of membranes, it is possible to prevent the second sheet being degraded over time by the fluid contained in the container. Moreover, by improving the gas barrier properties thereof, the preservability of the fluid is improved.

Advantageous Effects of the Invention

According to the container for mixing two liquids and the like of the present invention, because the proportion that is occupied by the top portion of the container which houses a first cutter relative to the overall size of the container is smaller than in a conventional structure, it is possible to achieve a reduction in the size of the container. Moreover, it is possible to reduce the number of components compared with a conventional structure.

DESCRIPTION OF THE REFERENCE SYMBOLS

1: Container body, 3: Aperture portion, 11: Pouring component, 12: Apex plate, 13: Inner cylinder, 14: Outer cylinder, 15: Pouring cylinder, 16: Inward facing flange, 17: First cutter, 21: Container, 31: Cap, 33: Outer circumferential wall, 34: Weakened line, 35: Removable cylinder, 41: Small container, 43: Apex wall, 44: Circumferential wall, 44*a*: Outward facing flange, 45: First sheet, 51: Second sheet, 51*a*: End surface, 52: Arm, 52*a*: End surface, 53: Second cutter, 60: Thin plate, 60*a*, Side edge, 60*b*: Wide diameter portion, 61: Hinge, L: Second cutter trajectory, 70: Stopper, 70*a*, 70*b*: Inclined surfaces

BEST MODE FOR CARRYING OUT THE INVENTION

Figure 2:
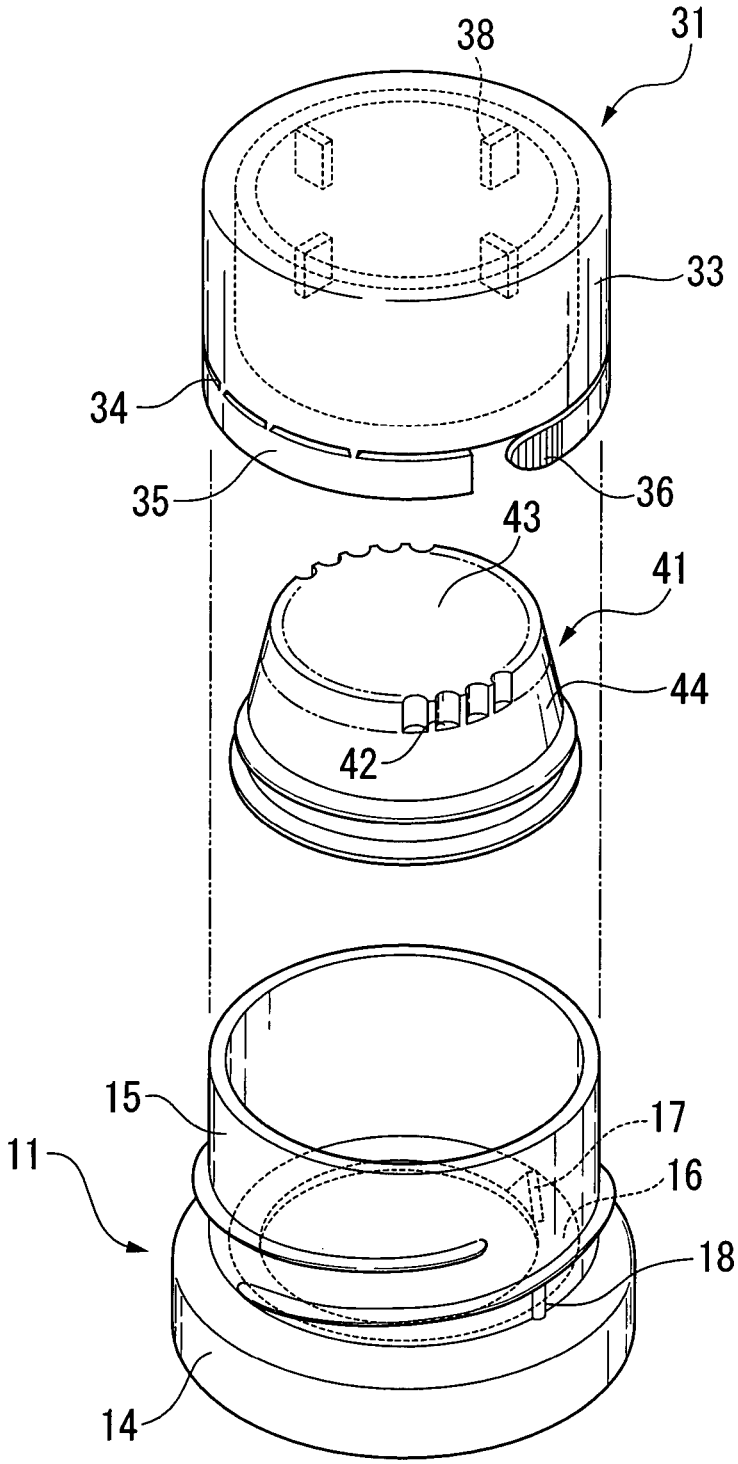
FIG. 2 is an exploded perspective view of the principal portions of the container shown in FIG. 1.
Figure 3:
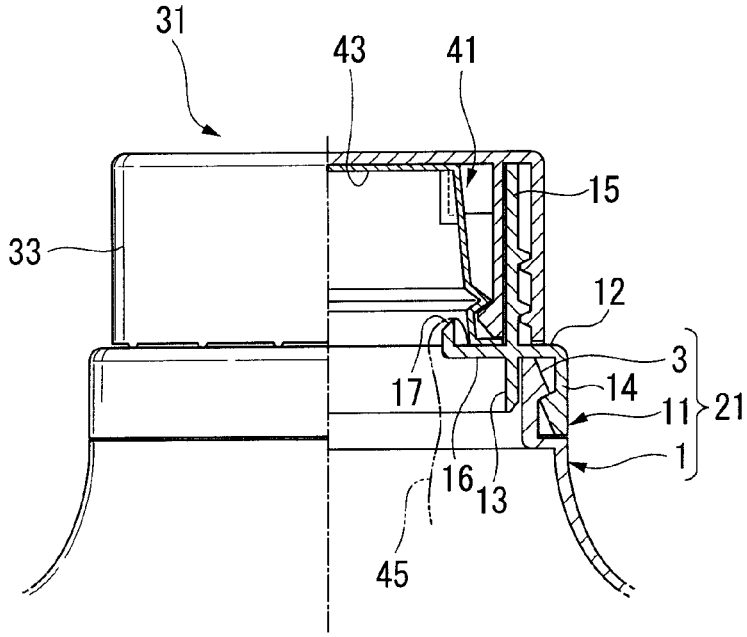
FIG. 3 is a semi cross-sectional view showing a state in which a removable cylinder has been removed from a cap, the cap has been screwed down onto a pouring cylinder, and a first sheet has been cut.

A first embodiment of the container for mixing two liquids and the like of the present invention will now be described with reference made to FIGS. 1 through 3.

Figure 1:
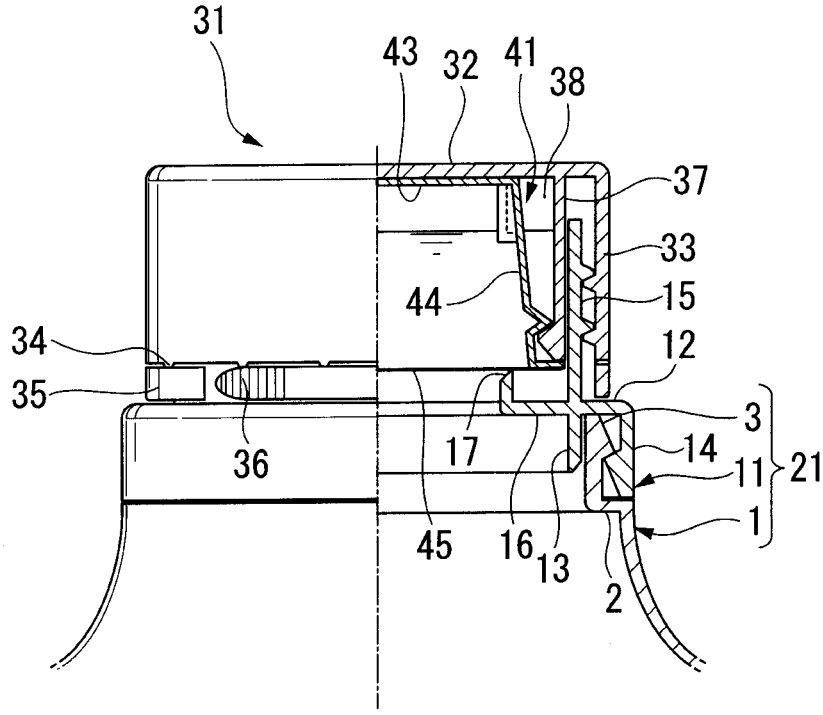
FIG. 1 is a semi cross-sectional view of principal portions of a container and shows a first embodiment of the container for mixing two liquids and the like of the present invention.

As is shown in FIG. 1, the container for mixing two liquids and the like of the present invention is formed by a container 21 that contains a first liquid, a cap 31 that is attached to the container 21, and a small container 41 that contains a second liquid. A pouring cylinder 15 that is provided so as to extend upright from a top portion of the container 21 and an upward facing step portion that is formed so as to be positioned below the pouring cylinder 15 are provided in the container 21.

The container 21 is formed by a container body 1, an aperture portion 3 that is provided extending upright from a top portion of the container body 1, and a pouring component 11 that has the pouring cylinder 15 and is engaged such that it is unable to pivot in the aperture portion 3. The aperture portion 3 is provided via an inward facing flange 2 at the top portion of the container body 1. A projection is formed in a toroidal shape on an outer circumferential surface of a top end of the aperture portion 3.

The pouring component 11 is provided with a flange-shaped apex portion 12 that is provided at a bottom end of the pouring cylinder 15, an outer cylinder 14 that hangs vertically downwards from the apex plate 12, an inner cylinder 13 that is placed on an inner side of the outer cylinder 14 and hangs vertically downwards from the apex plate 12, and an inward facing flange 16 that is provided so as to protrude from the apex plate 12 onto an inner side of the pouring cylinder 15. A projection is formed in a toroidal shape on an inner circumferential surface of a bottom end of the outer cylinder 14.

The pouring component 11 is fitted such that is unable to pivot inside the aperture portion 3 by inserting the aperture portion 3 between the outer cylinder 14 and the inner cylinder 13, and engaging the projection on the aperture portion 3 side with the projection on the outer cylinder 14 side. The pouring cylinder 15 extends upright from the top portion of the container 21 as a result of the pouring component 11 being fitted into the aperture portion 3. The apex plate 12 constitutes the aforementioned upward facing step portion.

A cap 31 is removably fitted onto the pouring cylinder 15. The cap 31 is provided with an apex wall 32, an outer circumferential wall 33 that hangs vertically downwards from the apex wall 32, and an inner circumferential wall 37 that is placed on an inner side of the outer circumferential wall 33 and hangs vertically downwards from the apex wall 32. A male threaded portion is formed on an outer circumferential surface of the pouring cylinder 15, and a female threaded portion is formed on an inner circumferential surface of the outer circumferential wall 33 of the cap 31. By inserting the inner circumferential wall 37 into the inner side of the pouring cylinder 15, and engaging the male threaded portion on the pouring cylinder 15 side with the female threaded portion on the outer circumferential wall 33 side, the cap 31 is removably attached to the pouring cylinder 15.

A removable cylinder 35 is provided at a bottom end of the cap 31 by being inserted between the cap 31 and the upward facing step portion. The removable cylinder 35 is provided so as to hang down from a bottom end of the outer circumferential wall 33 via a weakened line 34 that is formed by a number of connecting elements and the like. As is shown in FIG. 2, a portion of the removable cylinder 35 is severed into segmented grooves, and a pull-off portion 36 is formed at one end of this severed portion. A bottom end surface of the removable cylinder 35 is placed on the apex plate 12 of the pouring component 11 that forms the upward facing step portion of the container 21. The removable cylinder 35 is removed from the cap 31 prior to the cap 31 being screwed down onto the pouring cylinder 15. If the removable cylinder 35 is not removed, then it is not possible to screw down the cap 31.

The small cylinder 41 has a configuration in which the cap is inverted, and is provided with an apex wall 43 and a circumferential wall 44 that hangs vertically downwards from the apex wall 43. A bottom surface of the small container 41 is formed by a cuttable first sheet 45. The apex wall 43 and the circumferential wall 44 are formed by thickly stacking a number of membrane layers that act as barriers to oxygen, light, carbon dioxide, inert gas and the like in accordance with the characteristics of the material being stored. The first sheet 45 forming the bottom surface of the small container 41 and the like is formed in a similar way as the apex wall 43 and the circumferential wall 44 by thinly stacking a number of membrane layers that act as barriers to oxygen, light, carbon dioxide, inert gas and the like.

The small container 42 is placed on an inner side of the cap 31 with the first sheet 45 underneath it. A projection is formed in a toroidal shape that projects towards the inner side on an inner circumferential surface of a bottom end of the inner circumferential wall 37 of the cap 31. In contrast, a projection is formed in a toroidal shape that projects towards the outer side on an outer circumferential surface of the circumferential wall 44 of the small container 41. As a result of the projection on the inner circumferential wall side of the cap 31 engaging with the projection on the circumferential wall 44 side, the small container 41 is engaged on the inner side of the cap 31. Moreover, as is shown in FIG. 2, a number of recessed portions 42 that are used to prevent slipping are provided on a top portion of the circumferential wall 44 of the small container 41. In contrast, a plurality of projections 38 are formed on an inner circumferential surface on a top end of the inner circumferential wall 37 of the cap 37. If the small container 41 is fitted inside the cap 31, the projections 38 engage with the recessed portions 42, which results in any pivoting of the small container 41 relative to the cap 31 being prevented.

A first cutter 17 is provided on the container 21 facing a bottom surface of the small container 41 that has been positioned on the inside of the cap 31. The first cutter 17 is located at an offset position away from the center of the pouring cylinder 15, and is provided in an upwardly protruding configuration integrally with the inward facing flange 16 that is provided on the pouring component 11.

When a container for mixing two liquids and the like having the above described structure is opened, firstly, the removable cylinder 35 is removed from the cap 31 by pulling off the pull-off portion 36. Next, the cap 31 is screwed down onto the pouring cylinder 15. When the cap 31 is screwed down, the bottom surface of the small container 41 that is placed inside the cap 31 drops down while rotating, and the first sheet 45 touches against the blade tip of the first cutter 17. Next, as is shown in FIG. 3, the first cutter 17 punctures the first sheet 45. Because the first cutter 17 is provided at a position offset from the center of the pouring cylinder 15, as the cap 31 is screwed down, the first sheet 45 is cut in an arc shape. When the first sheet 45 is cut, the second liquid that is contained inside the small container 41 flows through the pouring cylinder 15 into the container 21 and mixes together with the first liquid that was contained in the container 21. After the first and second liquids are mixed, the cap 31 is pulled out from the pouring cylinder 15 and the mixed liquid is poured out from the container 21.

According to the container for mixing two liquids and the like having the above described structure, because it is possible to mix two liquids together simply by cutting the first sheet 45, it is not necessary to secure as long a movement distance for the cutter 17 as in a conventional container. Accordingly, this structure has the advantage that the proportion of the pouring component 11 relative to the container 21 that is used to house the first cutter 17 can be smaller than in a conventional container. Moreover, the number of components is less than in a conventional container.

Furthermore, by combining the container body 1 and the pouring component 11 that has the pouring cylinder 15, it is easy to form the container 21 having the pouring cylinder 15.

Moreover, because the first cutter 17 is provided integrally with the inward facing flange 16 of the pouring component 11, it is easy to form the first cutter 17 in the container 21.

By also engaging the small container 41 on the inside of the inner circumferential wall 37 of the cap 31, the small container 41 can be easily fixed to the cap 31.

Furthermore, by stacking a plurality of membranes so as to form a first sheet 45 that has excellent corrosion resistance, it is possible to prevent the first sheet 45 being degraded over time by the second liquid contained in the small container 41.

It should be noted that it is preferable for the first sheet 45 not to be cut out in a circular shape and completely detached, but for a portion thereof to be left uncut thereby enabling the detached portion to hang down. If the cut portion is completely detached, it falls into the container 21 and floats in the first liquid. Therefore, as is shown in FIG. 2, a stopper 18 that restricts the amount of rotation of the cap 31 is provided at a portion of the outer circumferential surface of the bottom end of the pouring cylinder 15. When, in the process of being screwed down, the cap 31 is rotated substantially one revolution from the position where the first cutter 17 initially began to cut the first sheet 45 and is again approaching that initial cutting position, the stopper 18 touches the bottom end of the female thread of the cap 31 and any further rotation by the cap 31 is prevented. As a result, although the first sheet 45 is cut in a circular configuration, one portion is left uncut and the detached portion is allowed to hang down.

In addition to the above, for example, it is also possible to form the same type of stopper in a portion of the inner circumferential surface of the top end of the outer circumferential wall 33 of the cap 31. If a stopper is provided in this location, then when, in the process of being screwed down, the cap 31 is rotated substantially one revolution from the position where the first cutter 17 initially began to cut the first sheet 45 and is again approaching that initial cutting position, the stopper touches the top end of the pouring cylinder 15 and any further rotation by the cap 31 is prevented.

It should also be noted that in the present embodiment, the aperture portion 3 is inserted between the outer cylinder 14 and the inner cylinder 13, and the pouring component 11 is connected to the container body 1 as a result of the projection on the aperture 3 side becoming engaged with the projection on the outer cylinder 14 side. However, it is possible to connect the two using a different engaging device to this, or to form the container 21 with the two being formed as a single unit.

Furthermore, in the present embodiment, the removable cylinder 35 is provided integrally with the cap 31, however, it is also possible to provide the removable cylinder 35 independently from the cap 31. For example, it is also possible to fit a removable cylinder 35 that has been formed separately from the cap 31 in advance on the outer circumferential surface of the pouring cylinder 15 and then mount this on the apex plate 12, and then mount the bottom end of the outer circumferential wall 33 of the cap 31 on the apex plate 12 so as to sandwich the removable cylinder 35.

In the present embodiment, the inner circumferential wall 37 is provided on the inner side of the cap 31 and the small container 41 is fitted into this inner side, however, it is also possible to forgo providing the inner circumferential wall 37 and to join the apex wall 43 of the small container 41 to the bottom surface of the apex wall 32 of the cap 31 using some suitable device.

In the present embodiment, a liquid is contained in both the container 21 and the small container 41, however, substance that is contained in these is not limited to liquids and may be any fluid that has been provided with fluidity. For example, it is also possible to provide a liquid in the container 21 and to provide a granular material that flows easily in the small container 41.

Moreover, it is also possible to provide a liquid that does not contain carbon gas in the container 21 and to provide a food additive that generates carbon when mixed with the liquid in the small container 41, and, when the food additive seal is opened, to mix this food additive in the liquid and thereby generate carbon gas in the liquid. Here, in order to generate carbon gas in the liquid, it is necessary for an acidic component and a carbonic acid component to be included in the food additive. Examples of the acidic component include citric acid, ascorbic acid, succinic acid, lactic acid, aluminum potassium sulfate (burnt alum), and the like. Examples of the carbonic acid component include sodium hydrogen carbonate (sodium bicarbonate), sodium carbonate, ammonium hydrogen carbonate, calcium carbonate, potassium carbonate, ammonium carbonate, and the like. The two components generate carbon gas when mixed with water. Note that it is also possible for both the acidic component and the carbonic acid component to be contained in the small container 41. It is also possible for the carbonic acid component alone to be contained in the small container 41 and for the acidic component to be added to the liquid in the container 21, or alternatively, for the acidic component alone to be contained in the small container 41 and for the carbonic acid component to be added to the liquid in the container 21.

As is described above, when the seal of the container for mixing two liquids and the like is opened, carbon dioxide is generated, and as a result of the liquid in the container 21 being changed into a carbonic acid drink, the following advantages are obtained. Namely, when a liquid containing carbon dioxide is loaded from the beginning in the container 21, then it is necessary to use a container 21 and a cap 31 that are provided with sufficient capability to withstand pressure in consideration of safety during the loading process and during transporting. In contrast, when carbon dioxide is generated by opening the seal of a container for mixing two liquids and the like, it is not necessary to load a liquid containing carbon dioxide into the container 21. As a result, there is no need for a capability to withstand pressure as high as that required when a liquid containing carbon dioxide is loaded from the beginning into a container. Accordingly, there is a heightened degree of freedom when designing the container 21 and the cap 31. However, when the seal of a container for mixing two liquids and the like is opened and a consumer is drinking the contents, or when a user ceases drinking after taking only a small drink of the contents and closes the cap 31, there is a rise in internal pressure. Consequently, a certain level of pressure withstanding capability is required.

A second embodiment of the container for mixing two liquids and the like of the present invention will now be described with reference made to FIGS. 4 through 7. Note that component elements that have already been described in the first embodiment are given the same symbols and a description thereof is omitted. Only those portions that are different from the first embodiment are described.

Figure 4:
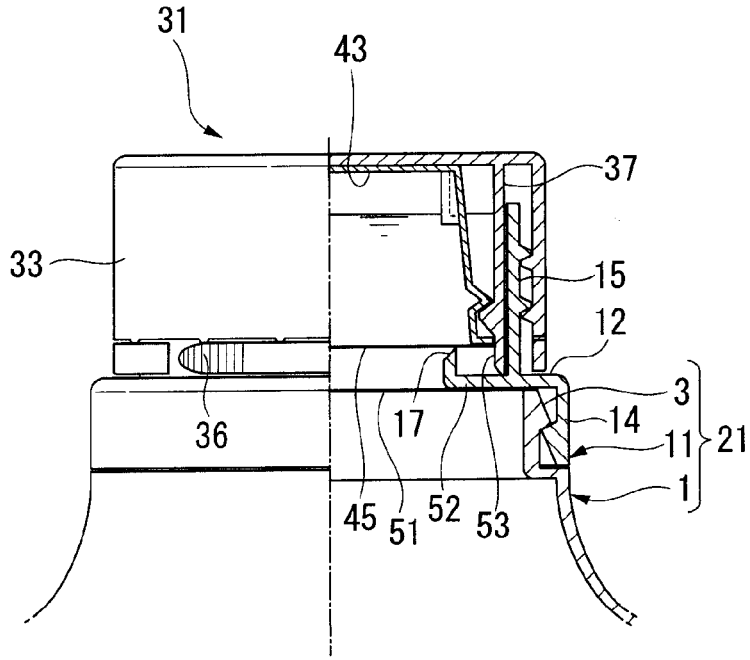
FIG. 4 is a semi cross-sectional view of principal portions of a container and shows a second embodiment of the container for mixing two liquids and the like of the present invention.

As is shown in FIG. 4, the container 21 is provided with a second sheet 51 that blocks off the pouring cylinder 15 and is able to be cut. In the same way as the first sheet 45, the second sheet 51 is formed by thinly stacking a number of membrane layers that act as barriers to oxygen, light, carbon dioxide, inert gas and the like, and is adhered to the bottom end surface of the pouring cylinder 15.

The cap 31 is provided with a second cutter 53 that is provided facing the second sheet 51. The second cutter 53 is provided integrally with a portion of the bottom end of the inner circumferential wall 37 so as to protrude downwards.

Figure 5:
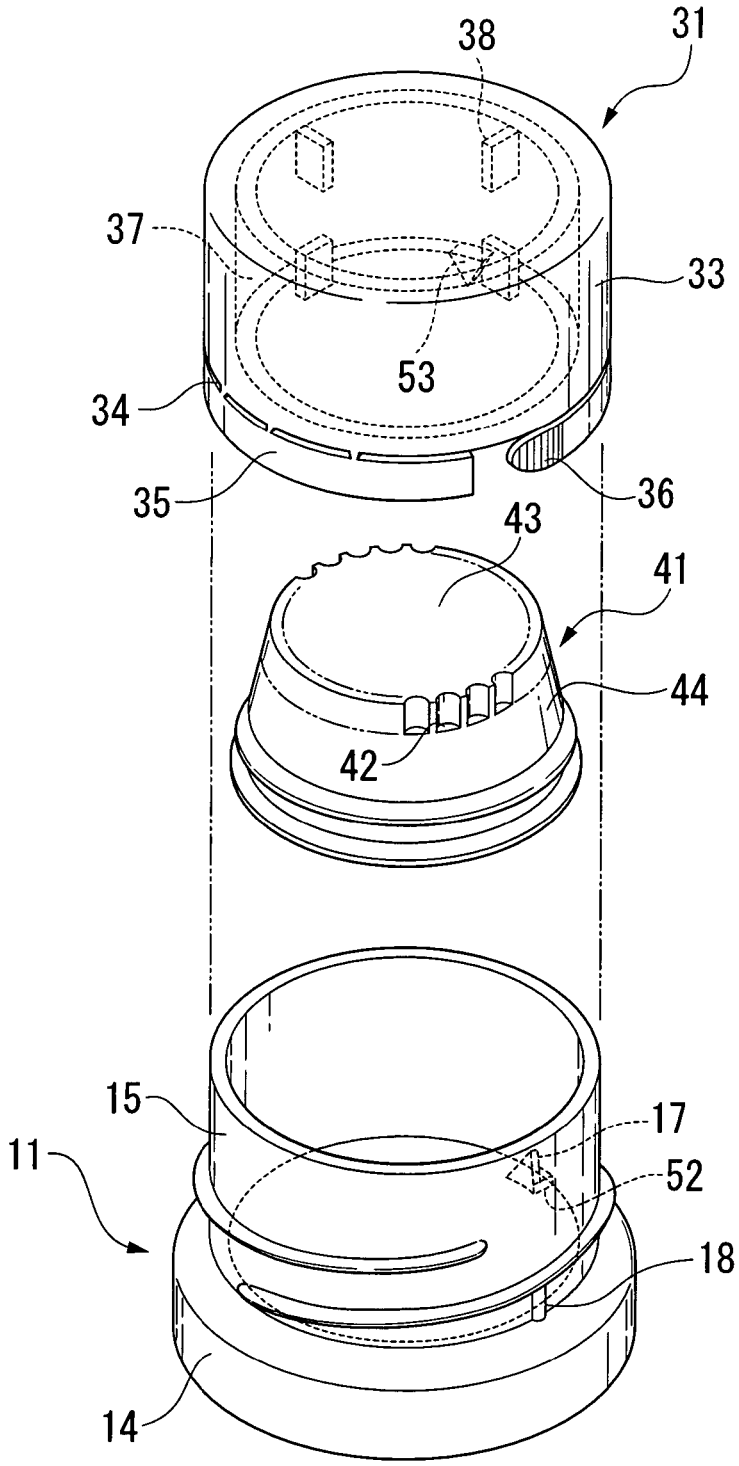
FIG. 5 is an exploded perspective view of the principal portions of the container shown in FIG. 4.
Figure 6:
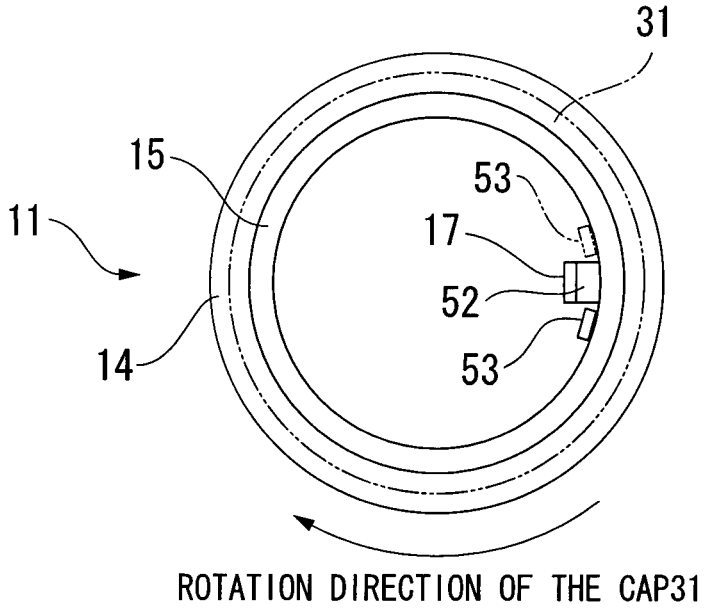
FIG. 6 is a planar cross-sectional view of principal portions of a container showing a positional relationship between a first cutter and a second cutter.

As is shown in FIG. 5, in order to avoid interfering with the second cutter 53, instead of being provided integrally with the inward facing flange 16, the first cutter 17 is provided so as to protrude upwards integrally with a distal end of an arm 52 that is provided so as to protrude from the apex plate 12 onto the inner side of the pouring cylinder 15. As is shown in FIG. 6, in a state before the cap 31 has been screwed down, the second cutter 53 is located in front of the first cutter 17.

When opening the seal of a container for mixing two liquids and the like having the above described structure, when the cap 31 is screwed down, the bottom surface of the small container 41 that is placed inside the cap 31 drops down while rotating, and the first sheet 45 touches against the blade tip of the first cutter 17, and the first cutter 17 punctures the first sheet 45. At the same time, the second cutter 53 drops down while moving in a direction away from the first cutter 17, and the blade tip of the second cutter 53 touches the second sheet 51 and punctures the second sheet 51.

Because the first cutter 17 is provided at a position offset from the center of the pouring cylinder 15, as the cap 31 is screwed down, the first sheet 45 is cut in an arc shape.

Figure 7:
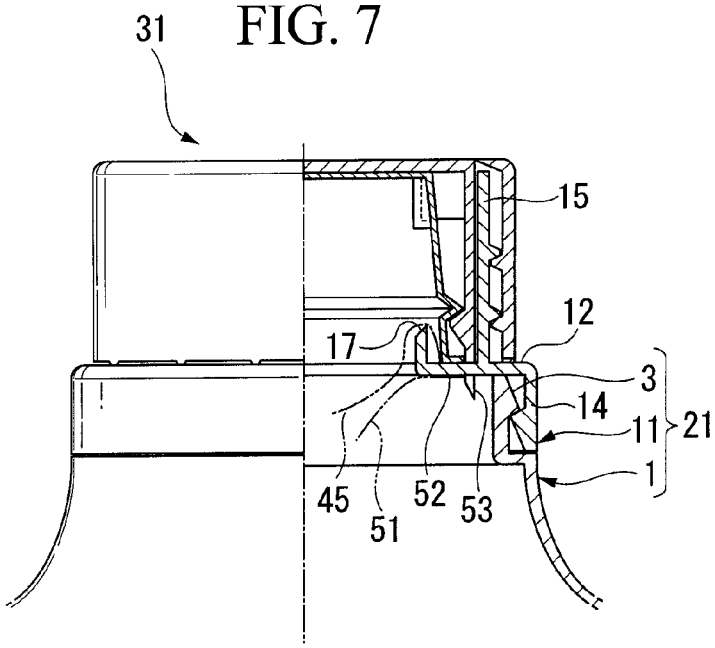
FIG. 7 is a semi cross-sectional view showing a state in which a removable cylinder has been removed from a cap, the cap has been screwed down onto a pouring cylinder, and a first sheet and second sheet have been cut.

In addition, because the second cutter 53 is provided at the bottom end of the inner circumferential wall 37 of the cap 31, as the cap 31 is screwed down, the second sheet 51 is also cut in an arc shape. When, in the process of being screwed down, the cap 31 is rotated substantially one revolution from the position where the second cutter 53 initially began to cut the second sheet 51 and is again approaching that initial cutting position, as is shown in FIG. 7, the second cutter 53 touches the arm 52 and any further rotation by the cap 31 is prevented.

When the first sheet 45 and the second sheet 51 are both cut, the second liquid that is contained inside the small container 41 flows through the pouring cylinder 15 into the container 21 and mixes together with the first liquid that was contained in the container 21. After the first and second liquids are mixed, the cap 31 is pulled out from the pouring cylinder 15 and the mixed liquid is poured out from the container 21.

According to the container for mixing two liquids and the like having the above described structure, because the pouring cylinder 15 of the container 21 is closed off by the second sheet 51, when the container for mixing two liquids and the like is being transported, the first liquid contained in the container 21 does not enter into the interior of the cap 31. Accordingly, when removing the cap 31, because the first liquid has not entered the interior of the cap 31, it is possible to prevent any unintentional liquid spillage.

By stacking a plurality of membranes so as to form a second sheet 51 that has excellent corrosion resistance, it is possible to prevent the second sheet 51 being degraded over time by the second liquid contained in the container 21.

A third embodiment of the container for mixing two liquids and the like of the present invention will now be described with reference made to FIG. 8. Note that component elements that have already been described in the first embodiment are given the same symbols and a description thereof is omitted. Only those portions that are different from the first embodiment are described.

Figure 8:
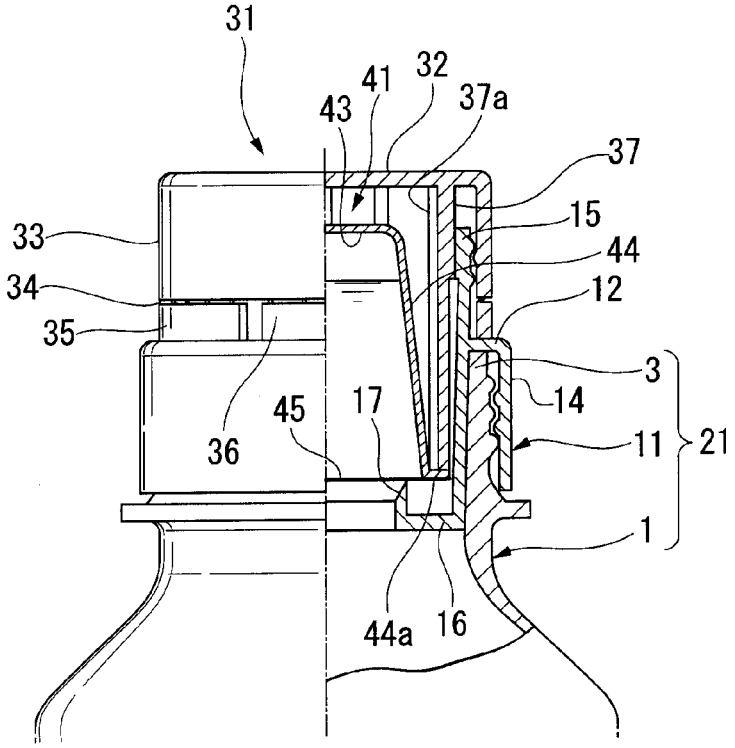
FIG. 8 is a semi cross-sectional view of principal portions of a container and shows a third embodiment of the container for mixing two liquids and the like of the present invention.

As is shown in FIG. 8, the small container 41 is provided with an apex wall 43, a circumferential wall 44 that hangs vertically downwards from the apex wall 43, and an outward facing flange **44*a* that is provided so as to protrude outwards from the bottom end of the circumferential wall 44. Moreover, a suitable number of ribs 37*a* are formed in a vertical direction on an inner side surface of the inner circumferential wall 37. A top surface of the outward facing flange 44*a* is adhered by ultrasonic adhesion and the like to the bottom end surface of the inner circumferential wall 37 of the cap 31 and the ribs 37*a*, and the interior of the inner circumferential wall 37 is tightly sealed by the small container 41. Note that the adhering of the outward facing flange 44*a* may be performed prior to the loading of the second liquid in the small container 41, or alternatively may be performed after the second liquid has been loaded into the small container 41 and this has then been sealed by the first sheet 51**.

According to the container for mixing two liquids having the above described structure, excellent hygiene is obtained due to no cleaning solution entering between the cap 31 and the small container 41 when the first solution or the like is being loaded into the container body 1.

Moreover, by adhering the small container 41 to the cap 31 in the manner described above, it is not necessary to form the engaging projections that engage with each other on the circumferential wall 44 of the small container 41 and on the inner circumferential wall 37 of the cap 31 as in the first embodiment.

A fourth embodiment of the container for mixing two liquids and the like of the present invention will now be described with reference made to FIGS. 9 through 11. Note that component elements that have already been described in the first embodiment are given the same symbols and a description thereof is omitted. Only those portions that are different from the first embodiment are described.

Figure 9:
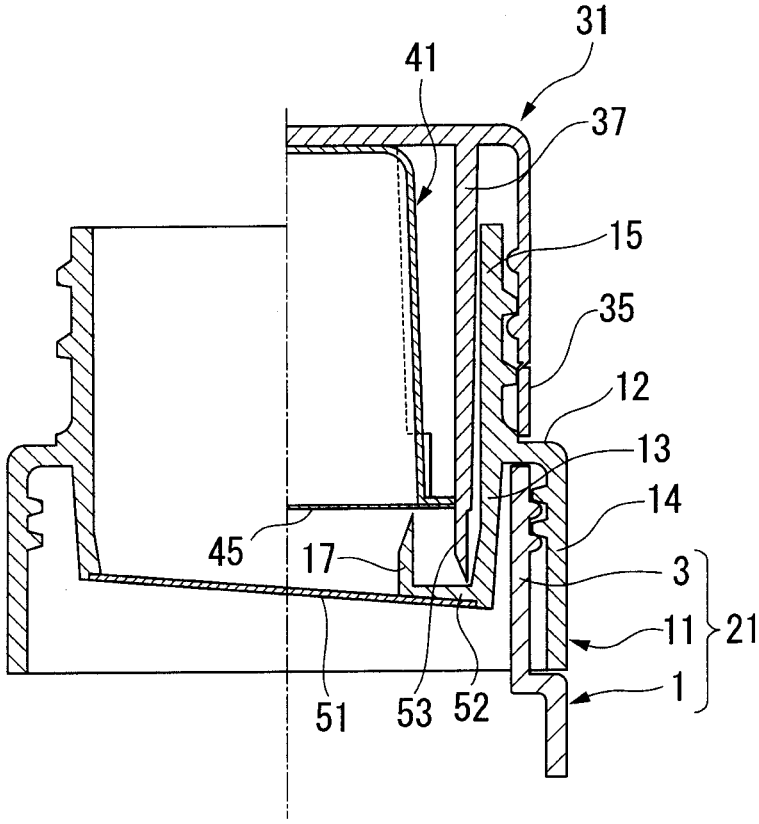
FIG. 9 is a semi cross-sectional view of principal portions of a container and shows a fourth embodiment of the container for mixing two liquids and the like of the present invention.
Figure 10:
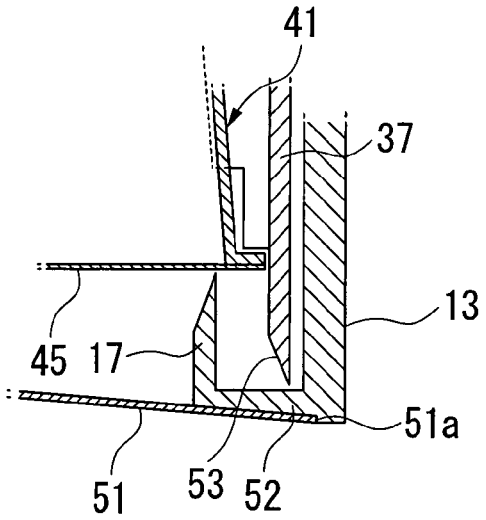
FIG. 10 is a cross-sectional view of principal portions showing a second sheet that is joined to a bottom end of an inner cylinder of a pouring component.

As is shown in FIG. 9, a bottom end surface of the inner cylinder 13 is formed so as to be slightly inclined relative to a vertical direction of the container 21. Furthermore, this inclined surface is formed such that portions close to the first and second cutters 17 and 53 prior to the removal of the removable cylinder 35 are the lowest. In addition, the second sheet 51 is joined to the bottom end surface of the inclined inner cylinder 13. More specifically, as is shown in FIG. 10, an end surface 51*a* of the second sheet 51 undergoes in-mold molding to the pouring component 11 when the pouring component 11 is being manufactured in order that it does not become adhered to the resin material forming the inner cylinder 13 and become exposed.

Moreover, the arm 52 that supports the first cutter 17 is provided at the bottom end of the inner cylinder 13, while the second sheet 51 is also adhered to a bottom surface of the arm 52.

The operations of each portion when the container for mixing two liquids and the like of the present invention having the above described structure is unsealed are based on the above described second embodiment and are therefore not described in detail. However, what requires a special mention in the present embodiment is the point of difference that, because the second sheet 51 is provided on an inclination, in the process of screwing down the cap 31, the change in the gap between the second cutter 53 and the second sheet 51 in the process of lowering the second cutter 53, namely, the distance to which the two approach each other is greater than when the second sheet 51 is not inclined. The fact that the change in the gap between the second cutter 53 and the second sheet 51 increases means that the distance that the second cutter 53 approaches to the second sheet 51 becomes longer. As a result, the second cutter 53 is able to reliably cut the second sheet 51. Furthermore, because the second cutter 53 cuts a large hole in the second sheet 51 and the dropping of the second liquid is not blocked by the cut second sheet 51, the first liquid can be made to drop unhindered into the container 21.

In addition, it is not necessary to control the gap between the second sheet 51 and the second cutter 53 when the cap 31 is being fitted onto the pouring cylinder 15 as precisely as when the second sheet 51 has not been inclined. Because the change in the gap between the second cutter 53 and the second sheet 51 is not that great when the second sheet 51 is not inclined, as is described above, if the gap between the second sheet 51 and the second cutter 53 is not made as narrow as possible, the amount by which the second cutter 53 is able to cut the second sheet 51 is shortened, and the cut portion may become an obstacle to the dropping of the second liquid. Because of this, it is necessary to perform production control such as adjusting the length of the second cutter 53, or adjusting the screwing down distance when the cap 31 is rotated one revolution. However, if the second sheet 51 is inclined, the change in the gap between the second cutter 53 and the second sheet 51 is made greater and a certain amount of dimensional error may be tolerated. Consequently, even if the aforementioned precise control is not performed, the second sheet 51 can be reliably cut by the required amount.

Furthermore, the second sheet 51 has a three-layer structure in which, for example, an aluminum film is sandwiched between films of the same material as the pouring component 11, however, because the end surface 51*a* of the second sheet 51 is tightly adhered to the resin material forming the bottom end of the pouring cylinder 15 and is not exposed to the outside, the end surface 51*a* of the second sheet 51 does not come into contact with the first liquid contained in the container 21. As a result, the material of the second sheet 51 that is exposed to the end surface 51*a* (i.e., the aluminum film and the like that is interposed in the center) does not become eroded by the first liquid. Accordingly, it is possible to improve the durability of the second sheet 51.

It should be noted that in the present embodiment the second sheet 51 is adhered to the bottom end surface of the pouring cylinder 15, however, it is also possible for the second sheet 51 to be joined to the bottom end surface of the pouring cylinder 15 by insert molding, alternatively, when molding the pouring component 11, the second sheet 51 may be formed integrally with the bottom end surface of the pouring cylinder 15.

Figure 11:
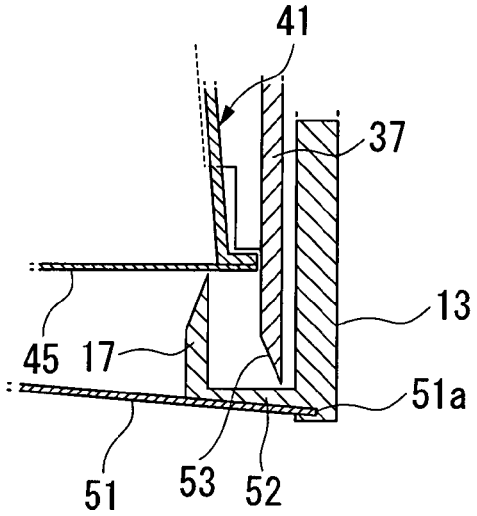
FIG. 11 is a cross-sectional view of principal portions showing a second sheet that is joined to a bottom end of an inner cylinder of a pouring component in a different embodiment from that in FIG. 10.

Furthermore, as is shown in FIG. 11, not only the end surface 51*a* of the second sheet 51, but also the end surface 51*a* and a portion of the sheet surface on both sides thereof may also be in-mold molded to the pouring component 11.

A fifth embodiment of the container for mixing two liquids and the like of the present invention will now be described with reference made to FIGS. 12 and 13. Note that component elements that have already been described in the first and second embodiments are given the same symbols and a description thereof is omitted. Only those portions that are different from these embodiments are described.

Figure 12:
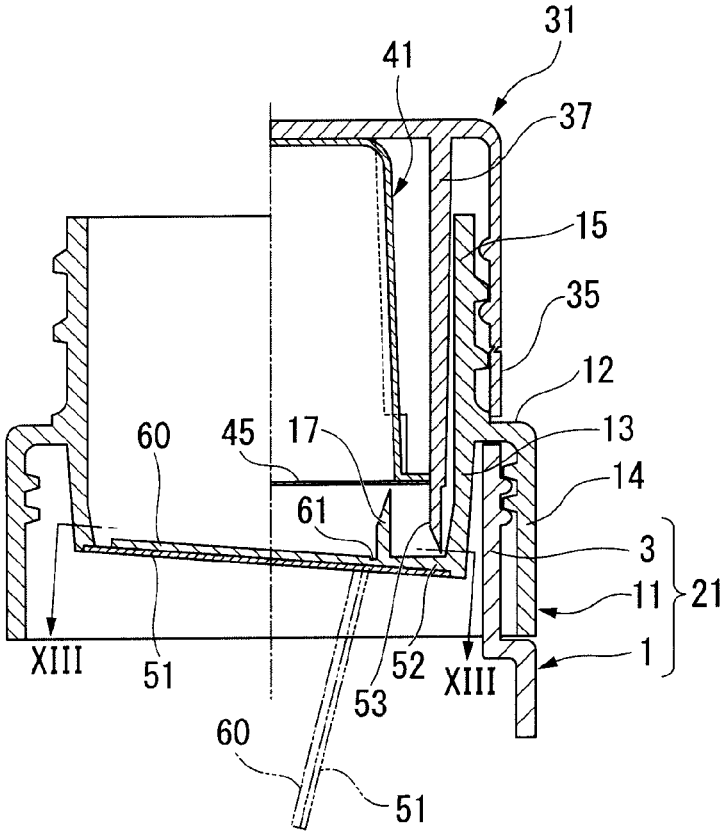
FIG. 12 is a vertical cross-sectional view of principal portions of a container and shows a fifth embodiment of the container for mixing two liquids and the like of the present invention.
Figure 13:
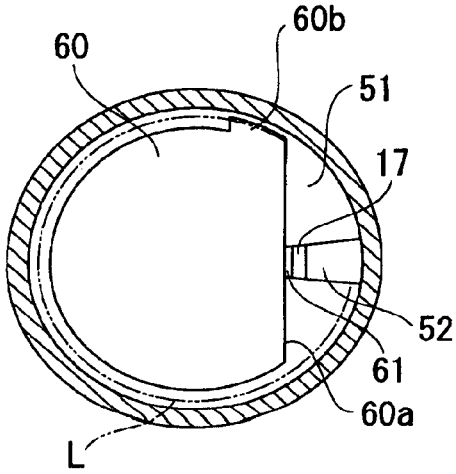
FIG. 13 is a cross-sectional view taken along a line A-A in FIG. 12.

As is shown in FIG. 12, a thin plate 60 formed from the same material as the pouring component 11, and a hinge 62 that is formed from the same material as the thin plate 60 are provided on a top surface of the second sheet 51. The thin plate 60 and the hinge 61 are molded integrally with the arm 52 when the pouring component 11 is resin molded. As is shown in FIG. 13, the shape of the thin plate 60 as seen from above is a circular shape having a portion thereof cut away in a straight line. The diameter of the thin plate 60 is slightly smaller than the internal diameter of the inner cylinder 13. The hinge 61 is provided on a side edge 60*a* of the thin plate 60 that is molded in a straight line. The thin plate 60 is connected to the arm 52 via the hinge 61. Moreover, an enlarged diameter portion 60*b* whose radius is larger than the other portions is formed on a portion of the circumferential edge of the thin plate 60 that is adjacent to the side edge 60*a*. The enlarged diameter portion 60*b* is adjacent to the position where the cutting of the second sheet 51 by the second cutter 53 ends, and is provided so as to be superimposed on a trajectory L of the second cutter 53. Note that the thin plate 60 may be adhered or not adhered to the second sheet 51.

The operations of each portion when the container for mixing two liquids and the like of the present invention having the above described structure is unsealed are based on the above described second embodiment and are therefore not described in detail. However, what requires a special mention in the present embodiment is the point of difference that the cut second sheet 51 is opened up fully. When the cap 31 is screwed down, the second cutter 53 is lowered while moving in a direction away from the first cutter 17, and the blade tip of the second cutter 53 punctures the second sheet 51. The second cutter 53 collides with the enlarged diameter portion 60*b* in the process of cutting second sheet 51, and the blade tip of the second cutter 53 pushes the enlarged diameter portion 60*b* downwards together with the thin plate 60. As a result of the thin plate 60 being pushed downwards, the hinge 61 is bent and when, finally, the second cutter 53 has cut the second sheet 51 over almost its entire circumference, as is shown by the virtual line in FIG. 12, the cut second sheet 51 is made to hang downwards together with the thin plate 60 that is connected to the arm 52 via the hinge 61. As a result, because the cut second sheet 51 does not obstruct dropping of the second liquid, the contents of the small container 41 can be made to drop unobstructed into the container 21.

A sixth embodiment of the container for mixing two liquids and the like of the present invention will now be described with reference made to FIGS. 14 and 15. Note that component elements that have already been described in the first and second embodiments are given the same symbols and a description thereof is omitted. Only those portions that are different from these embodiments are described.

Figure 14:
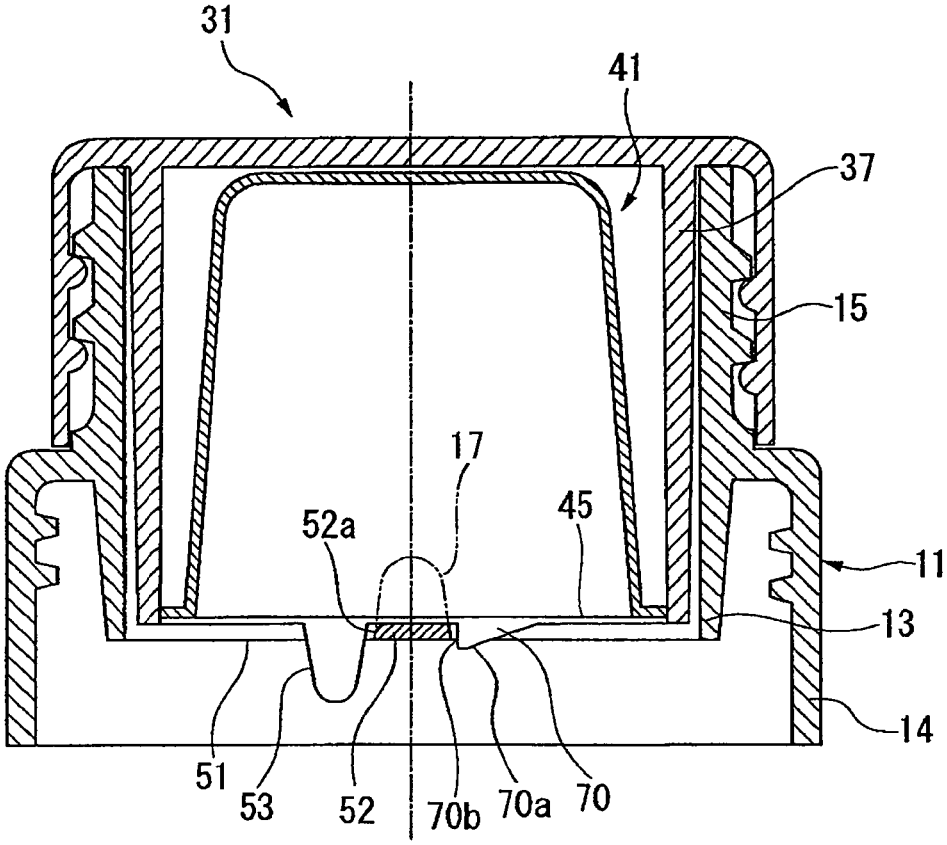
FIG. 14 is a semi cross-sectional view of principal portions of a container and shows a sixth embodiment of the container for mixing two liquids and the like of the present invention.
Figure 15:
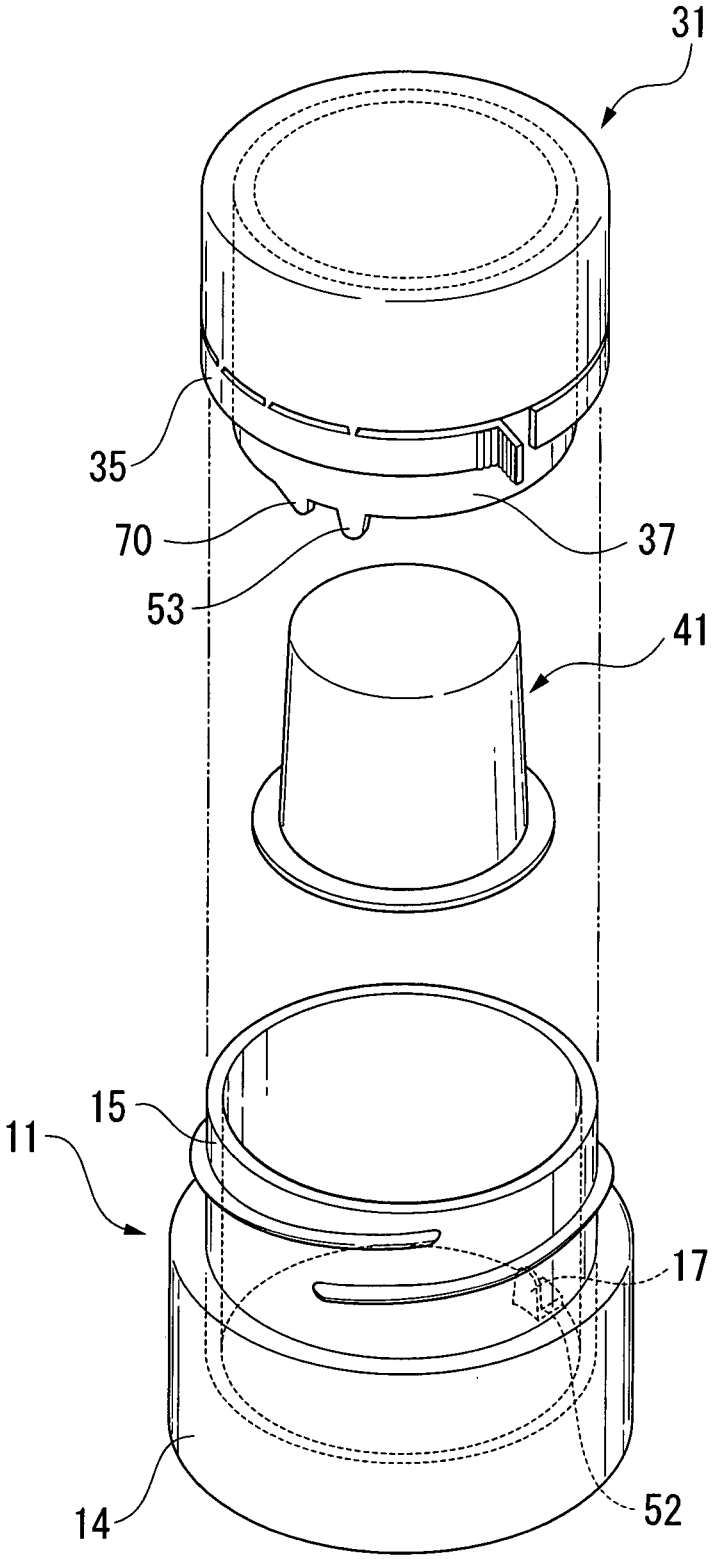
FIG. 15 is an exploded perspective view of the principal portions of the container shown in FIG. 14.

As is shown in FIGS. 14 and 15, a stopper 70 that engages with the arm 52 after the first sheet 45 and the second sheet 51 have been cut is provided on the inner circumferential wall of the cap 31. The stopper 70 is placed on a bottom end of the inner circumferential wall 37 in front of the second cutter 53 in the screwing down direction of the cap 31 so as to be adjacent to the second cutter 53. The gap between the second cutter 53 and the stopper 70 is made slightly wider than the width of the arm 52. The stopper 70 is a projection that protrudes downwards from the bottom end surface of the inner circumferential wall 37 and this projection is formed by two inclined surfaces 70*a* and 70*b*. Of the two inclined surface 70*a* and 70*b*, the inclined surface 70*a* that is positioned at the front in the direction in which the cap 31 is screwed down is gently inclined relative to the bottom end surface of the inner circumferential wall 37. In contrast, the inclined surface 70*b* that is positioned at the rear in the direction in which the cap 31 is screwed down is formed substantially perpendicular to the bottom end surface of the inner circumferential wall 37. The end surface 52*a* that is positioned at the rear of the arm 52 in the direction in which the cap 31 is screwed down is gently inclined such that the stopper 70 can easily ride over the arm 52 when the cap 31 is screwed down.

The operations of each portion when the container for mixing two liquids and the like of the present invention having the above described structure is unsealed are based on the above described second embodiment and are therefore not described in detail. However, what requires a special mention in the present embodiment is the point of difference that, after the first sheet 45 and the second sheet 51 have been cut, as a result of the arm 52 being positioned between the second cutter 53 and the stopper 70, any pivoting of the cap 31 in either the forward or reverse direction is obstructed. When the cap 31 is screwed down, finally, the second cutter 53 cuts the second sheet 51 over almost its entire circumference. If the cap 31 continues to be rotated after this, the inclined surface 70*a* of the stopper 70 comes up against the end surface 52*a* of the arm 52. If the cap 31 is then screwed down still further, because both the inclined surface 70*a* and the end surface 52 are both formed as gentle slopes, the stopper 70 rides over the arm 52 without any sizable resistance being generated. When the stopper 70 rides over the arm 52, because the second cutter 53 touches the arm 52, any further rotation by the cap 31 is blocked. Moreover, even if an attempt is made to rotate the cap 31 in the opposite direction to the screwing down direction, because the steep inclined surface 70*b* of the stopper 70 touches the arm 52, any rotation of the cap 31 in the opposite direction is obstructed.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

Industrial Applicability

The present invention relates to a container for mixing two liquids and the like that is provided with: a container; a pouring cylinder that is provided extending upwards on a top portion of the container; an upward facing step portion that is formed on the container so as to be positioned below the pouring cylinder; a cap whose inner circumferential surface is screwed onto an outer circumferential surface of the pouring cylinder; a small container that is placed on an inner side of the cap; a cuttable first sheet that forms a bottom surface of the small container; a removable cylinder that is provided at a bottom end of the cap and is interposed between the cap and the upward facing step portion, and that is removed from the cap prior to the cap being screwed down onto the pouring cylinder; and a first cutter that is provided on the container body so as to face a bottom surface of the small container that is placed on the inner side of the cap, wherein the small container is made to approach the first container as a result of the cap being screwed down onto the pouring cylinder, and the first sheet is then cut by the first cutter. According to the container for mixing two liquids and the like of the present invention, because the proportion that is occupied by the top portion of the container which houses a first cutter relative to the overall size of the container is smaller than in a conventional structure, it is possible to achieve a reduction in the size of the container. Moreover, it is possible to reduce the number of components compared with a conventional structure.

The invention claimed is:

1. A container for mixing fluids comprising:

a container configured to contain one of the two fluids;

a pouring cylinder that is provided extending upwards on a top portion of the container;

an upward facing step portion that is formed on the container so as to be positioned below the pouring cylinder;

a cap that is removably attached to the pouring cylinder;

a male threaded portion that is formed on an outer circumferential surface of the pouring cylinder;

a female threaded portion that is formed on an inner circumferential surface of the cap and that is engaged with the male threaded portion to attach the cap to the pouring cylinder;

a small container that is placed on an inner side of the cap and is configured to contain an other of the two fluids;

a cuttable first sheet that forms a bottom surface of the small container;

a removable cylinder that is provided at a bottom end of the cap and is interposed between the cap and the upward facing step portion, and that is removed from the cap prior to the cap being screwed down onto the pouring cylinder;

a stopper that is provided on the cap and is configured to restrict a rotation of the cap with respect to the pouring cylinder; and a first cutter that is provided on the container so as to face a bottom surface of the small container that is placed on the inner side of the cap, wherein the small container is made to approach the first cutter as a result of the cap being screwed down onto the pouring cylinder, the first sheet is cut by the first cutter circularly from a position where the first cutter initially began to cut the first sheet, and before the first cutter arrives at the position again, the stopper is configured to contact an arm provided on the pouring cylinder in a circumferential direction such that rotation of the cap with respect the pouring cylinder is restricted in a direction opposite to a direction that the cap is screwed down.

2. The container for mixing two fluids according to claim 1, wherein the container is provided with a container body, an aperture portion that is provided extending upright from a top portion of the container body, and a pouring component that has the pouring cylinder and is fitted onto the aperture portion such that it is unable to pivot, and the pouring cylinder is made to extend upright from the top portion of the container as a result of the pouring component being fitted to the aperture portion, and the first cutter is provided on the pouring component so as to protrude upwards.

3. The container for mixing two fluids according to claim 2, wherein the pouring component is provided with:

a flange-shaped apex plate that is provided at a bottom end of the pouring cylinder; an outer cylinder that hangs vertically down from the apex plate; an inner cylinder that is placed on an inner side of the outer cylinder and hangs vertically downwards from the apex plate, and an inward facing flange that is provided so as to protrude from the apex plate onto an inner side of the pouring cylinder, and the first cutter is provided on the inward facing flange so as to protrude upwards, and the pouring component is fitted to the aperture portion such that the aperture portion becomes inserted between the outer cylinder and the inner cylinder.

4. The container for mixing two fluids according to any of claims 1 through 3, wherein the cap is provided with an apex wall, an outer circumferential wall that hangs vertically downwards from the apex wall, and an inner circumferential wall that is placed on an inner side of the outer circumferential wall and hangs vertically downwards from the apex wall, and the small container engages with an inner side of the inner circumferential wall of the cap, and the cap is screwed onto the pouring cylinder so that the inner circumferential wall is inserted on an inner side of the pouring cylinder.

5. The container for mixing two fluids according to claim 4, wherein the small container is provided with an apex wall, a circumferential wall that hangs vertically downwards from the apex wall, and an outward facing flange that is provided so as to protrude outwards from the bottom end of the circumferential wall, and a top surface of the outward facing flange is adhered to a bottom end surface of the inner circumferential wall of the cap, and an interior of the inner circumferential wall is tightly sealed by the small container.

6. The container for mixing two fluids according to any of claims 1 through 3, wherein the container is provided with a cuttable second sheet that closes off the pouring cylinder, the cap is provided with a second cutter that is positioned facing the second sheet, and the second cutter is made to approach the second sheet as a result of the cap being screwed down onto the pouring cylinder and the second cutter then cuts the second sheet circularly.

7. The container for mixing two fluids according to claim 6, wherein the second sheet is joined to a bottom end surface of the pouring cylinder by insert molding.

8. The container for mixing two fluids according to claim 6, wherein the second sheet is adhered to the bottom end surface of the pouring cylinder.

9. The container for mixing two fluids according to claim 6, wherein the container is provided with a container body, an aperture portion that is provided extending upright from a top portion of the container body, and a pouring component that has the pouring cylinder and is fitted onto the aperture portion such that it is unable to pivot, and the second sheet is formed integrally with the bottom end surface of the pouring cylinder when the pouring component is molded.

10. The container for mixing two fluids according to claim 6, wherein an end surface of the second sheet is covered by the bottom end portion of the pouring cylinder by insert molding.

11. The container for mixing two fluids according to claim 6, wherein the second sheet is formed by stacking a plurality of membranes having barrier properties.

12. The container for mixing two fluids according to claim 6, wherein the first cutter is provided on the bottom end of an inner cylinder that hangs downwards from the pouring cylinder via the arm, and the stopper is provided on the bottom end of the inner circumferential wall of the cap so as to be adjacent to the second cutter, and after the first sheet and the second sheet have been cut circularly, any pivoting of the cap in either the forward or reverse direction is obstructed as a result of the arm being positioned between the second cutter and the stopper.

13. The container for mixing two fluids according to claim 12, wherein the stopper is a projection that protrudes downwards from the bottom end surface of the inner circumferential wall, the projection has a first inclined surface that is positioned at the front in the direction in which the cap is screwed down and a second inclined surface that is positioned at the rear in the direction in which the cap is screwed down, the first inclined surface is gently inclined relative to the bottom end surface of the inner circumferential wall, and the second inclined surface is formed substantially perpendicular to the bottom end surface of the inner circumferential wall.

14. The container for mixing fluids according to any of claims 1 through 3, wherein the small container is provided with an apex wall and a circumferential wall that hangs vertically downwards from the apex wall, and the apex wall and the circumferential wall of the small container are formed by thickly stacking a plurality of membranes having barrier properties, and the first sheet that forms the bottom surface of the small container is formed by stacking a plurality of membranes having barrier properties.

15. The container for mixing two fluids according to claim 1, wherein the small container is configured to contain, as the other of the two fluids, a granular material that flows easily.

* * * * *